US009890653B2

(12) United States Patent
Samudrala et al.

(10) Patent No.: US 9,890,653 B2
(45) Date of Patent: Feb. 13, 2018

(54) GAS TURBINE BUCKET SHANKS WITH SEAL PINS

(71) Applicant: General Electric Company, Schenectady, NY (US)

(72) Inventors: Omprakash Samudrala, Niskayuna, NY (US); David Richard Johns, Greenville, SC (US); Andrew Paul Giametta, Greenville, SC (US); Anthony Christopher Marin, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 342 days.

(21) Appl. No.: 14/680,083

(22) Filed: Apr. 7, 2015

(65) Prior Publication Data

US 2016/0298478 A1 Oct. 13, 2016

(51) Int. Cl.

| | |
|---|---|
| ***F01D 5/14*** | (2006.01) |
| ***F01D 11/00*** | (2006.01) |
| ***F01D 5/30*** | (2006.01) |
| *F01D 5/22* | (2006.01) |

(52) U.S. Cl.

CPC ..... *F01D 11/008* (2013.01); *F01D 5/147* (2013.01); *F01D 5/30* (2013.01); *F01D 11/006* (2013.01); *F01D 5/22* (2013.01); *F01D 11/001* (2013.01); *F05D 2220/32* (2013.01); *F05D 2230/60* (2013.01); *F05D 2240/30* (2013.01); *F05D 2240/55* (2013.01); *F05D 2240/80* (2013.01); *F05D 2250/231* (2013.01); *F05D 2250/241* (2013.01)

(58) Field of Classification Search

CPC ..... F01D 11/006; F01D 11/008

See application file for complete search history.

(56) References Cited

U.S. PATENT DOCUMENTS

| | | | | |
|---|---|---|---|---|
| 6,086,329 | A | 7/2000 | Tomita et al. | |
| 6,189,891 | B1 | 2/2001 | Tomita et al. | |
| 6,273,683 | B1 | 8/2001 | Zagar et al. | |
| 7,090,466 | B2 * | 8/2006 | Honkomp | F01D 5/3007 277/637 |
| 7,252,477 | B2 | 8/2007 | Tomita et al. | |
| 7,762,780 | B2 | 7/2010 | Decardenas | |
| 8,137,072 | B2 | 3/2012 | Kim et al. | |
| 8,573,942 | B2 * | 11/2013 | Strohl | F01D 5/3007 416/219 R |
| 8,820,754 | B2 * | 9/2014 | Stewart | F01D 5/22 277/641 |

(Continued)

OTHER PUBLICATIONS

European Search Report and Opinion issued in connection with corresponding EP Application No. 16163827.5 dated Jul. 22, 2016.

*Primary Examiner* — Woody Lee, Jr.
(74) *Attorney, Agent, or Firm* — Eversheds Sutherland (US) LLP

(57) ABSTRACT

The present application and the resultant patent provide improved gas turbine component sealing. In one example embodiment, a shank assembly may include a component shank with a platform including a first slash face. The shank assembly may include a seal pin slot extending into the first slash face, the seal pin slot having a slot length and a depth, and a seal pin disposed in the seal pin slot, the seal pin having a rounded end positioned adjacent to an end of the seal pin slot.

10 Claims, 8 Drawing Sheets

(56) References Cited

U.S. PATENT DOCUMENTS

| | | | | |
|---|---|---|---|---|
| 8,905,715 | B2 * | 12/2014 | Boyer | F01D 5/22 416/193 A |
| 2011/0081245 | A1 * | 4/2011 | Walunj | F01D 5/3015 416/179 |
| 2012/0121423 | A1 * | 5/2012 | Honkomp | F01D 11/006 416/190 |
| 2014/0030100 | A1 | 1/2014 | Joshi et al. | |
| 2014/0271205 | A1 | 9/2014 | Marasco et al. | |
| 2014/0271206 | A1 * | 9/2014 | Marasco | F01D 11/006 416/193 A |

* cited by examiner

GAS TURBINE BUCKET SHANKS WITH SEAL PINS

TECHNICAL FIELD

The present application and the resultant patent relate generally to gas turbine engines and more particularly relate to gas turbine bucket shanks with seal pins and the like for reducing leakage flow between components of a gas turbine engine.

BACKGROUND OF THE INVENTION

Generally described, turbo-machinery such as gas turbine engines and the like include a main gas flow path extending therethrough. Gas leakage, either out of the gas flow path or into the gas flow path, may lower overall gas turbine efficiency, increase fuel costs, and possibly increase emission levels. Secondary flows also may be used within the gas turbine engine to cool the various heated components. Specifically, cooling air may be extracted from the later stages of the compressor for use in cooling the heated components and for purging gaps and cavities between adjacent components. For example, seals may be placed at wheel space cavities between turbine components such as bucket wheels and the like to limit air leakage. Seals, however, may have different configurations, which may result in leakage flow escaping through gaps created by certain seals. Leakage flow may result in reduced efficiency of the gas turbine.

There is thus a desire for improved seal configurations for use with gas turbine components, such as bucket wheel components and other components of heavy duty gas turbine engines. Such seals may be configured to reduce or remove gaps between gas turbine components, resulting in reduced leakage flow therethrough, as well as increased overall efficiency and/or increased component lifetime.

SUMMARY OF THE INVENTION

The present application and the resultant patent provide a gas turbine component shank assembly including a shank with a platform having a first slash face. The gas turbine component shank assembly includes a seal pin slot extending into the first slash face, the seal pin slot having a slot length and a depth, and a seal pin disposed in the seal pin slot, the seal pin having a rounded end positioned adjacent to an end of the seal pin slot.

The present application and the resultant patent also provide a method of reducing a leakage flow in a gas turbine component. The method includes providing a first bucket shank with a first platform having a first slash face, and providing a second bucket shank with a second platform having a second slash face. The second slash face may be substantially planar and positioned adjacent to the first slash face. The method includes positioning a seal pin in a seal pin slot disposed within the first slash face, the seal pin slot having a slot length and a depth, where the seal pin has a rounded end positioned adjacent to an end of the seal pin slot. The method includes flowing hot gas in between the first slash face and the second slash face, where a hot gas path of the hot gas is occluded by the seal pin.

The present application and the resultant patent further provide a gas turbine seal assembly including a first shank having a first platform and a first dovetail extending from the first platform, where the first platform includes a first slash face on a first side of the first platform and a second slash face on a second side of the first platform opposite the first side. The gas turbine seal assembly may include a seal pin slot extending into the first slash face, the seal pin slot having a length defined along a major axis of the first slash face, a width defined along a minor axis of the first slash face, and a depth defined into the first slash face. The gas turbine seal assembly may include a seal pin disposed in the seal pin slot, the seal pin having a dome portion and a central portion disposed adjacent to the dome portion, where the central portion has a constant diameter, and the dome portion has a first end adjacent to the central portion and a second end forming an end of the seal pin. The first end has the constant diameter of the central portion, and the second end has a diameter less than the constant diameter. The gas turbine seal assembly may include a second shank positioned adjacent to the first shank having a second platform with a third slash face positioned such that the seal pin is retained in the seal pin slot.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
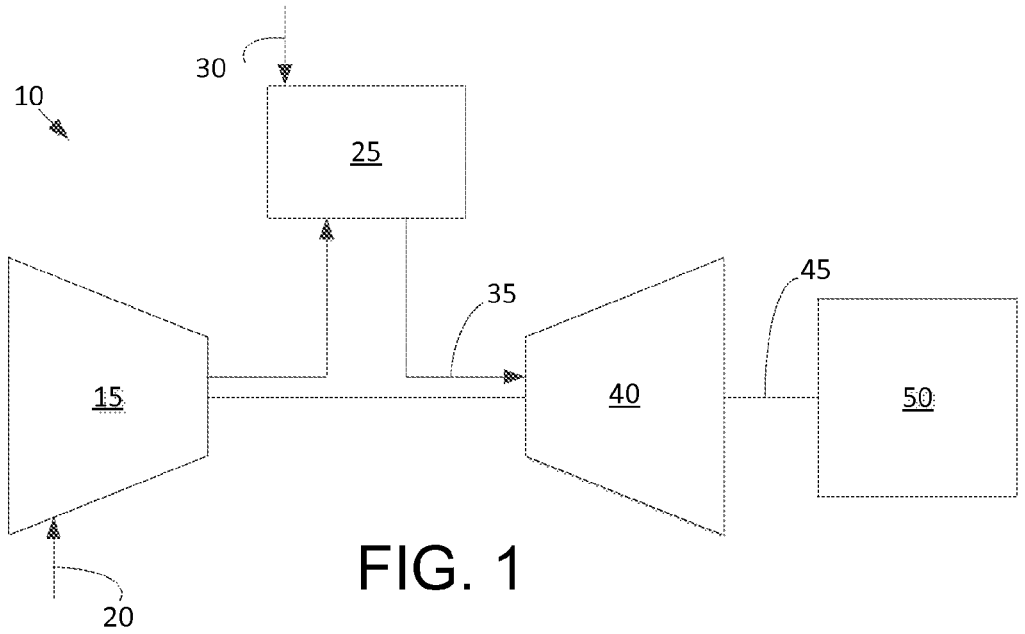
FIG. 1 schematically depicts an example of a gas turbine engine.

Referring now to the drawings, in which like numerals refer to like elements throughout the several views, FIG. 1 shows a schematic view of a gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like. Other configurations and other components may be used herein.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together. Although the gas turbine engine 10 is shown herein, the present application may be applicable to any type of turbo machinery.

Figure 2:
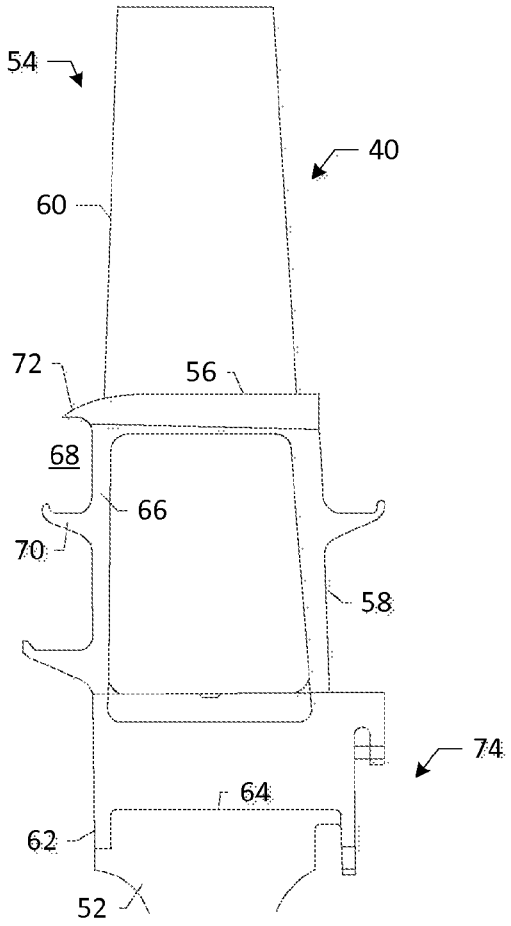
FIG. 2 schematically depicts an example cross-sectional view of a turbine bucket.

FIG. 2 schematically depicts one example embodiment of a portion of the turbine 40. The turbine 40 may include a rotor 52 positioned about a longitudinal axis. A number of buckets 54 may be mounted to the rotor 52. For example, the buckets 54 may be circumferentially position adjacent to one another and extend radially outward from the rotor 52. The buckets 54 may form one or more stages in the turbine 40. For example, the buckets 54 may form a first stage, a last stage, or any stage therebetween. The buckets 54 may include a platform 56, a shank portion 58, an airfoil 60, and a dovetail 62. The dovetail 62 may be configured to mate with a corresponding dovetail 64 of the rotor 52.

The shank portion 56 may include a slash face 66. The slash face 66 may be defined as a circumferential edge or edge surface of the shank portion 58. In some instances, the leading edge of the shank portion 58 may include a forward trench cavity 68. The forward trench cavity 68 may be formed between an angle wing seal 70 and a leading edge 72 of the platform 56. The forward trench cavity 68 may provide an area where purge air from a wheel space 74 interfaces with the hot combustion gases. The wheel space 74 may include a wheel space cavity formed between the rotor 52 and one or more stators positioned adjacent to the rotor 52. Other components and other configurations may be used herein.

Figure 3:
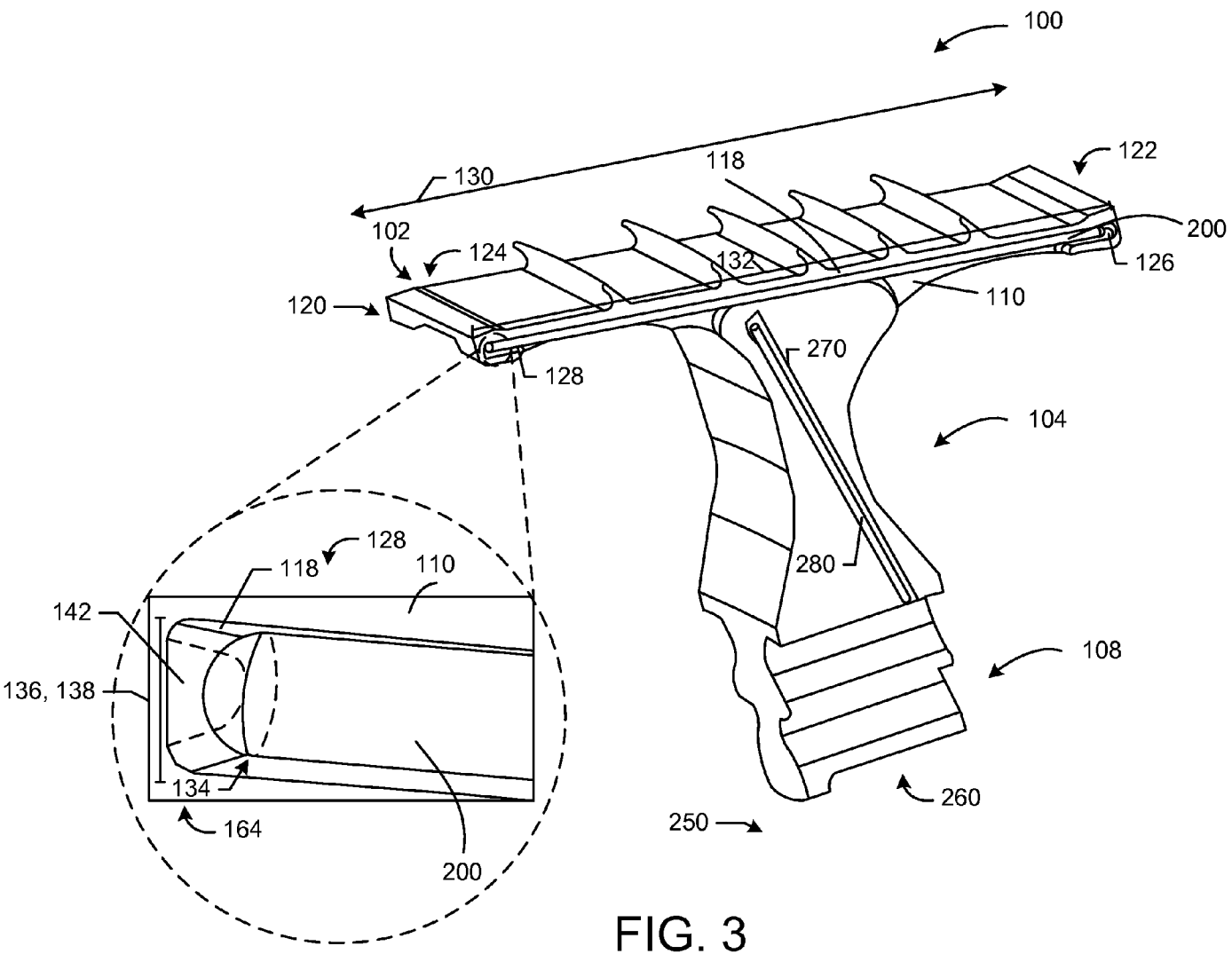
FIG. 3 schematically depicts an example perspective cross-sectional view of a turbine near flow path seal with a seal pin, according to one or more embodiments of the disclosure.

Referring to FIGS. 3-7, FIG. 3 depicts an example embodiment of a portion of a near flow path seal 100 and a seal pin 200 as may be used herein. Near flow path seal 100 may be mounted to a shaft via a seal member rotor, and may be configured to prevent an exchange of gases between a gas path and a wheel space of a turbomachine. The near flow path seal 100 may be mounted to a rotor of the turbomachine. The near flow path seal 100 may be one of multiple near flow path seals mounted to a rotor. The near flow path seal 100 may include may include a platform 102, a shank portion 104, and a dovetail 108 configured to mate with a rotor, or in some embodiments, a seal member rotor. The shank portion 104 may extend radially inward from the platform 102, and an airfoil may extend radially outward from the platform 102. The shank portion 104 may include a first slash face 110. The first slash face 110 may be the circumferential edge of the shank portion 104. Depending on the orientation of the airfoil, the first slash face 110 may be a pressure side slash face or a suction side slash face. For example, a slash face positioned about a pressure side of an airfoil may be a pressure side slash face, while a slash face positioned about a suction side of an airfoil may be a suction side slash face. While FIG. 3 illustrates a near flow path seal, embodiments of the disclosure include other gas turbine components with shanks, such as turbine buckets.

In embodiments of the disclosure, the near flow path seal 100 may include one or more seals mounted thereon configured to seal a wheel space cavity 250 from a hot gas path 260. In the embodiment of FIG. 3, the near flow path seal 100 may include a seal pin slot 118, which may be an axial seal pin slot or a radial seal pin slot in some embodiments, formed in the first slash face 110. The near flow path seal 100 may have a second slash face 120 on an opposite side of the first slash face 110 that is substantially planar or does not otherwise include the seal pin slot 118. The seal pin slot 118 may form a groove or cavity in the first slash face 110 configured to receive the seal pin 200. The seal pin slot 118 may extend at least partially from an aft end 122 of the platform 102 and/or first slash face 110 to a forward end 124 of the platform 102 and/or first slash face 110. More specifically, the seal pin slot 118 may have a first end 126 adjacent to the aft end 122 of the platform 102 and a second end 128 adjacent to the forward end 124 of the platform 102. The seal pin slot 118 may have a slot length 130 defined as an axial length of the seal pin slot 118 along the slash face. In some embodiments, the seal pin slot 118 may have a slot length 130 substantially equal to, or equal to, a length 132 of the first slash face 110. In other embodiments, the seal pin slot 118 may have a slot length 130 greater than half of a length of the first slash face 110. The seal pin slot 118 may have a depth 134 measured into the first slash face 118 and/or platform 102 from the first slash face surface. The seal pin slot 118 may have a constant depth or may have a varied depth, for example the seal pin slot 118 may have one or more chamfered edges at one or both ends of the seal pin slot 118. The seal pin slot 118 may have a width 136 or a height 138 measured radially along the platform 102 of the near flow path seal 100.

The seal pin 200 may be positioned within, or partially within, the seal pin slot 118 of the near flow path seal 100. The seal pin slot 118 may be sized and/or shaped to receive the seal pin 200 therein, in order to facilitate sealing between adjacent shank portions 104 when a number of turbine buckets 100 are coupled to the rotor. In some instances, only the pressure side slash face and/or the suction side slash face may include the seal pin slot 118, while an opposite side slash face may be substantially planar. In such embodiments, a substantially planar slash face that does not include the seal pin slot 118 and/or the seal pin 200 may form a seal with an adjacent turbine bucket that includes the seal pin slot 118 and the seal pin 200 by preventing the seal pin 200 from exiting the seal pin slot 118. While the seal pin 200 is illustrated as being positioned along the first slash face 110 of the platform 102, in other embodiments, the seal pin slot 118 may be positioned radially along, or substantially vertically along, the shank portion 104 of the near flow path seal 100. For example, in FIG. 3, the near flow path seal 100 may include a radial seal pin slot 270 along the shank portion 104 of the near flow path seal 100, and a vertical seal pin 280 positioned therein. Some embodiments may include either, or both, the seal pin slot 118 and the radial seal pin slot 270, and the respective seal pins 200, 280.

Figure 4:
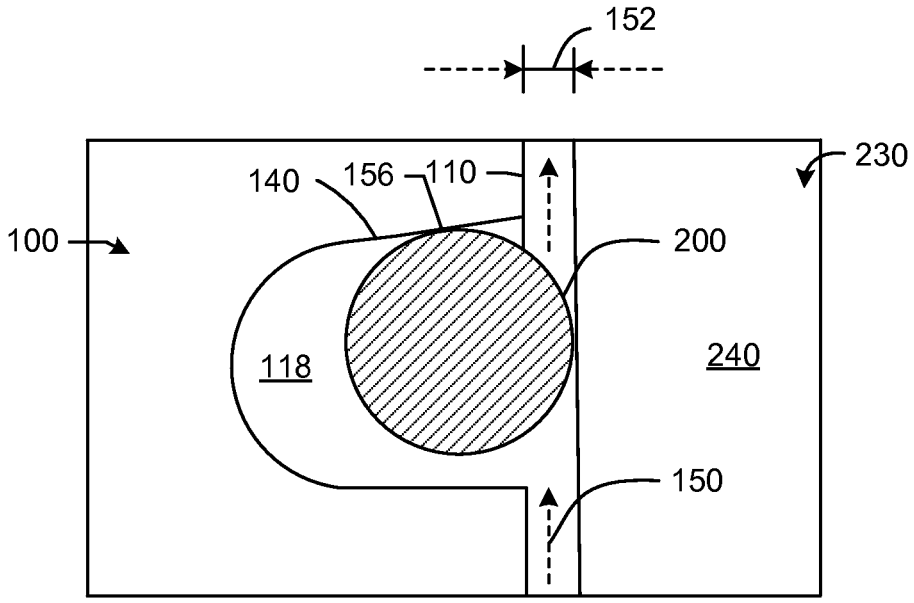
FIG. 4 schematically depicts a detailed cross-sectional view of a seal pin positioned in a seal slot of a gas turbine component shank, according to one or more embodiments of the disclosure.

Referring to FIG. 4, in some embodiments, the seal pin 200 may sit freely or otherwise unfixed in the seal pin slot 118, and may be held in position by the mating flat surface or a mating slash face 240 of an adjacent turbine bucket 230. The embodiment of FIG. 4 may be a turbine bucket or a near flow path seal. As the rotor and/or turbine buckets 100, 230 rotate when the gas turbine is in operation, the seal pin 200 may be forced radially outward and may roll against a slot roof 140 of the seal pin slot 118 until the seal pin 200 is forced against the flat surface or mating slash face 240 of the adjacent turbine bucket 230. As the turbine buckets 100, 230 rotate, the seal pin 200 may slide forward into a pocket 142 at the axially forward end 124 of the seal pin slot 118. Purge flow 150 may flow radially outward along a slash gap 152 in between the two adjacent turbine buckets 100, 230, creating a high pressure pocket underneath the seal pin 200 to prevent the hot gas from passing through the seal pin 200. In other embodiments, the seal pin 200 may be fixed in the seal pin slot, for example via a friction fit or a securing mechanism.

Because the seal pin 200 may be sized and/or shaped differently than the seal pin slot 118 or due to other gaps, hot gas, cooling air, and/or purge air may leak about the seal pin 200 when the seal pin 200 is positioned in the seal pin slot 118. For example, in FIG. 7, example leakage paths about the seal pin 200 are illustrated. A first leakage path 154 may be through the seal pin contact area 156 with the seal pin 200 and the seal pin slot 118, and a second leakage path 158 may be through the forward end gap or aft end gap 160 of the seal pin slot 118. The seal pins described herein may reduce the leakage flow about the seal pin 200, and in particular the leakage flow about the forward end and/or aft end gaps 160, 164 by reducing the effective clearance between the seal pin 200 and the respective ends of the seal pin slot 118. The seal pins described herein may also enhance the sealing of the slash gap 152, thereby resulting in a decreased amount of purge flow needed to maintain a desired differential pressure.

Figure 5:
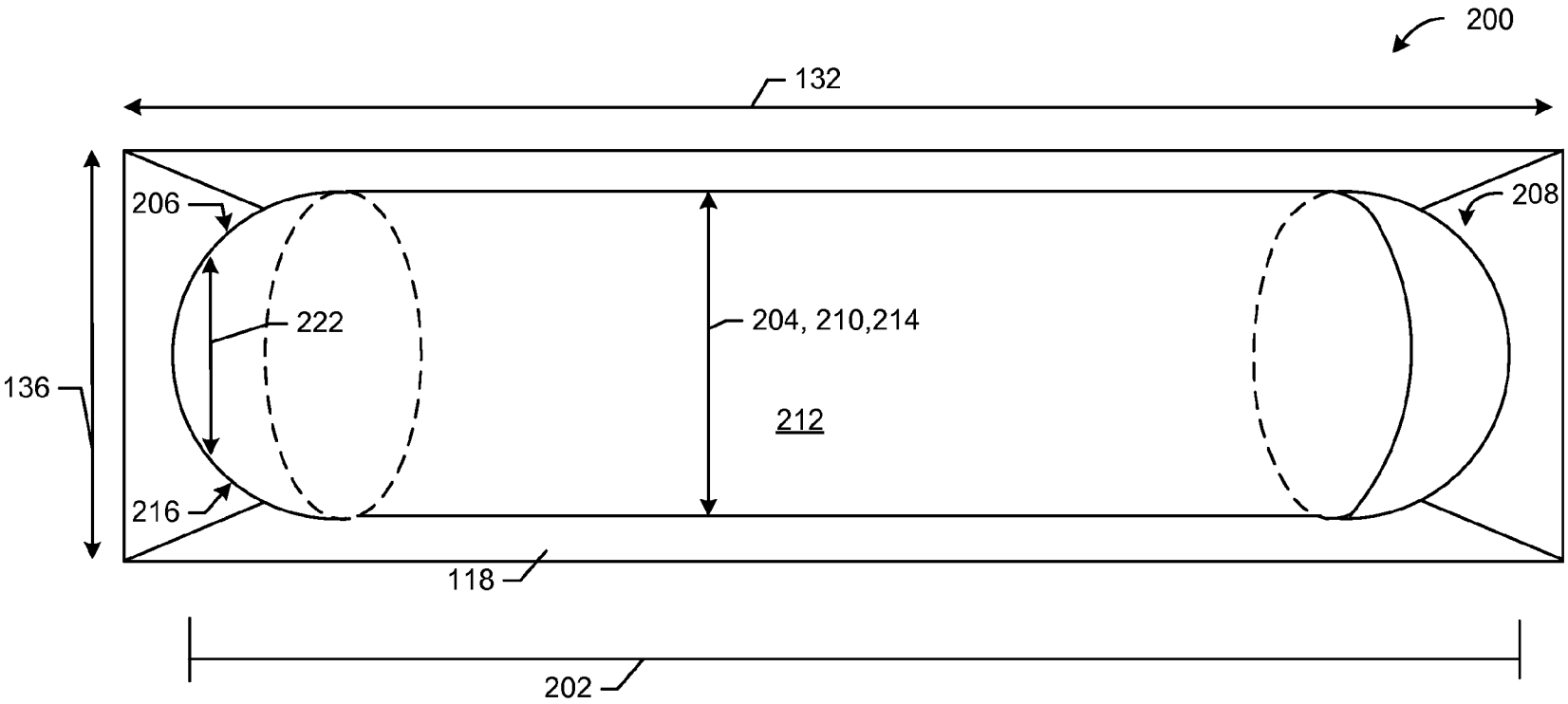
FIGS. 5-7 schematically depict portions of a seal pin positioned in a seal slot in perspective and detail views, according to one or more embodiments of the disclosure.
Figure 6:
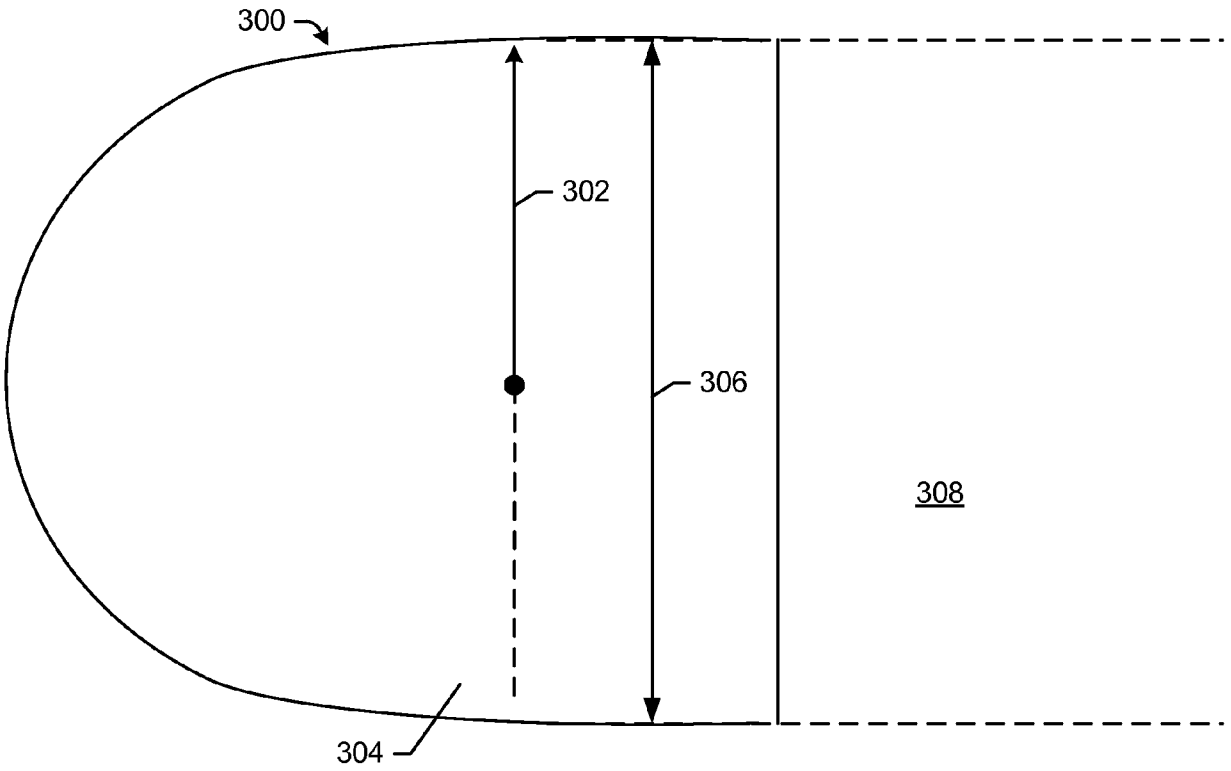
Figure 7:
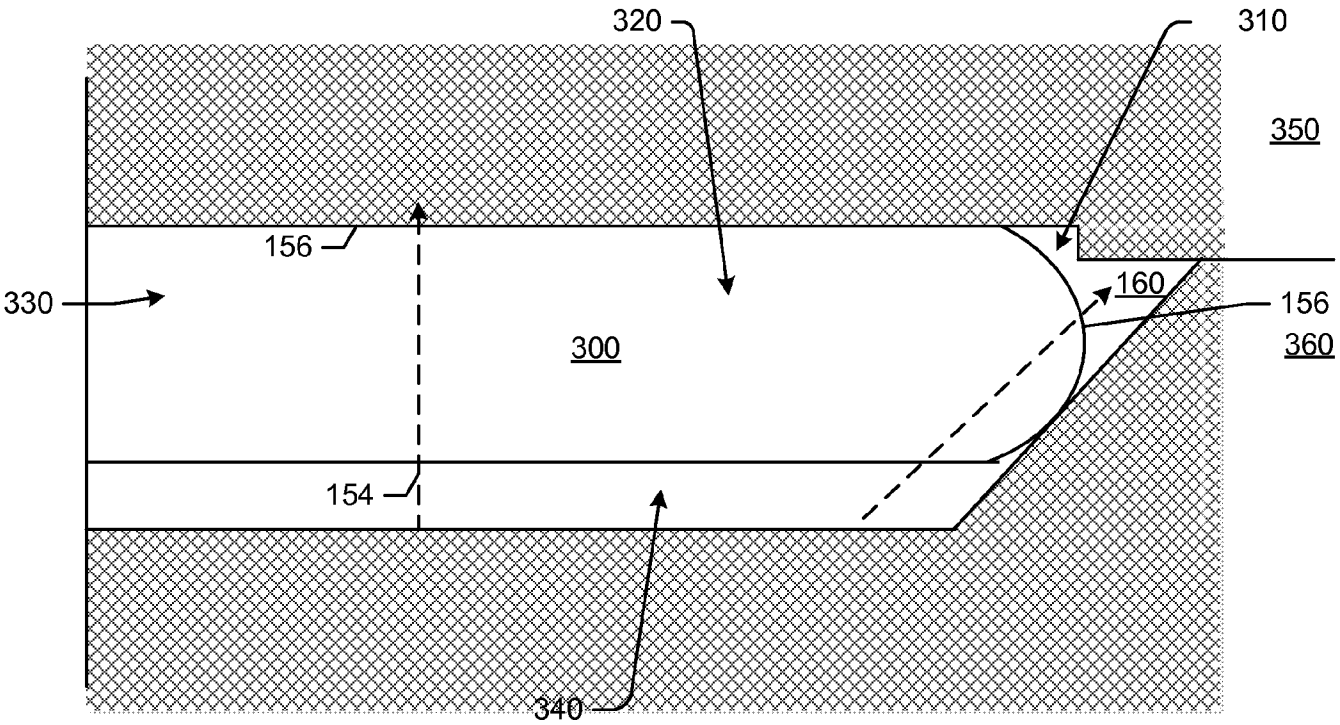

Referring now to FIGS. 5-7, one embodiment of the seal pin 200 is depicted. The seal pin 200 may have a seal pin length 202 and a seal pin width 204. The seal pin length 202 may be measured from a first outer end 206 of the seal pin 200 to a second outer end 208 of the seal pin 200. The seal pin length 202 may be less than the seal pin slot length 132 so as to accommodate thermal growth. The seal pin width 204 may be measured as a height of the seal pin 200 or a diameter 210 of the seal pin 200 in embodiments where the seal pin 200 has a cylindrical portion. The seal pin width 204 may vary or may otherwise be non-uniform, for example, a diameter of the seal pin at the first outer edge may be different than the seal pin width at a middle portion of the seal pin. The seal pin width 204 may be less than the slot width 136 of the seal pin slot 118, such that the seal pin 200 can move within the seal pin slot 118.

The seal pin 200 may include a central portion 212 in between and adjacent to the first and second outer ends 206, 208. The central portion 212 of the seal pin 200 may be substantially cylindrical in some embodiments. The central portion 212 may have a constant radius 214 or diameter. One or both of the first and second outer ends 206, 208 of the seal pin 200 may be rounded seal pin ends. The rounded seal pin ends may be positioned in the seal pin slot 118 so as to correspond to the first end 126 and the second end 128 of the seal pin slot 118, respectively. In embodiments where one or both of the first end 126 and the second end 128 of the seal pin slot 118 are chamfered or otherwise shaped, the rounded seal pin ends may be configured to fit within the seal pin slot 118 with a rounded geometry or configuration to facilitate positioning of the seal pin 200 in the seal pin slot 200. The seal pin 200 may be hollow in some embodiments, in that the seal pin 200 includes an inner diameter and an outer diameter, where the inner diameter defines a hollow portion of the seal pin 200 and the outer diameter defines an outer surface of the seal pin 200. The seal pin 200 may be formed from any suitable material.

The seal pin ends 206, 208 may have a specific geometry. Each respective seal pin end 206, 208 may have an identical or different geometry and/or configuration. For example, as illustrated in FIG. 5, the first seal pin end 206 of the seal pin 200 may have a first portion 216 adjacent to the central portion 212 that has the constant radius 214 of the central portion 212 so as to achieve a flush outer surface 218 at the interface between the central portion 212 and the first seal pin end 206. The first seal pin end 206 may further have a second portion 220 opposite the first portion 216 that has a radius 222 less than the constant radius 214 of the first portion 216 of the first seal pin end 206 and the central portion 212, such that the first seal pin end 206 forms a dome-like shape or dome-ended configuration at the outer end of the seal pin 200. The seal pin ends 206, 208 may reduce the effective clearance between the seal pin 200 and the seal pin slot end, as well as between adjacent turbine buckets, thereby reducing operation costs associated with the gas turbine, increasing lifespan of gas turbine components, and/or increasing overall efficiency of the gas turbine engine.

In FIG. 6, a detailed view of the dome portion 300 of the seal pin is illustrated. The dome portion 300 may have a dome radius 302 at an end 304 of a seal pin that is less than a radius 306 of a middle portion 308 of the seal pin, resulting in reduced leakage area, as well as a deterministic seating in a seal pin slot. The dome radius 302 of the dome portion (or dome portions for embodiments where both ends of the seal pin are dome-ended) at the end 304 of the seal pin 300 may be anywhere from hemispherical to less than substantially hemispherical. Specifically, the dome radius 302 or rounding radius of the dome portion may have a ratio with respect to a central or middle portion of the seal pin 300 to be anywhere from about 1.1 to about 1.8. In some embodiments, the dome radius 302 may be proportional to the radius 306 of the shank portion or middle portion 308 of the seal pin. For example, the dome radius 302 may have a ratio of about 1.8 with respect to the radius 306 of the middle portion 308 of the seal pin.

In the embodiments described herein, a seal pin with an end radius to pin radius ratio of 1 may be referred to as a hemispherical seal pin, whereas a seal pin with an end radius to pin radius of infinity may be referred to as a flat seal pin. Embodiments of the disclosure may have end radius to pin radius ratios of greater that or equal to about 1.0 and less than or equal to about 2.0, resulting in measurable reduced leakage flow.

Figure 8:
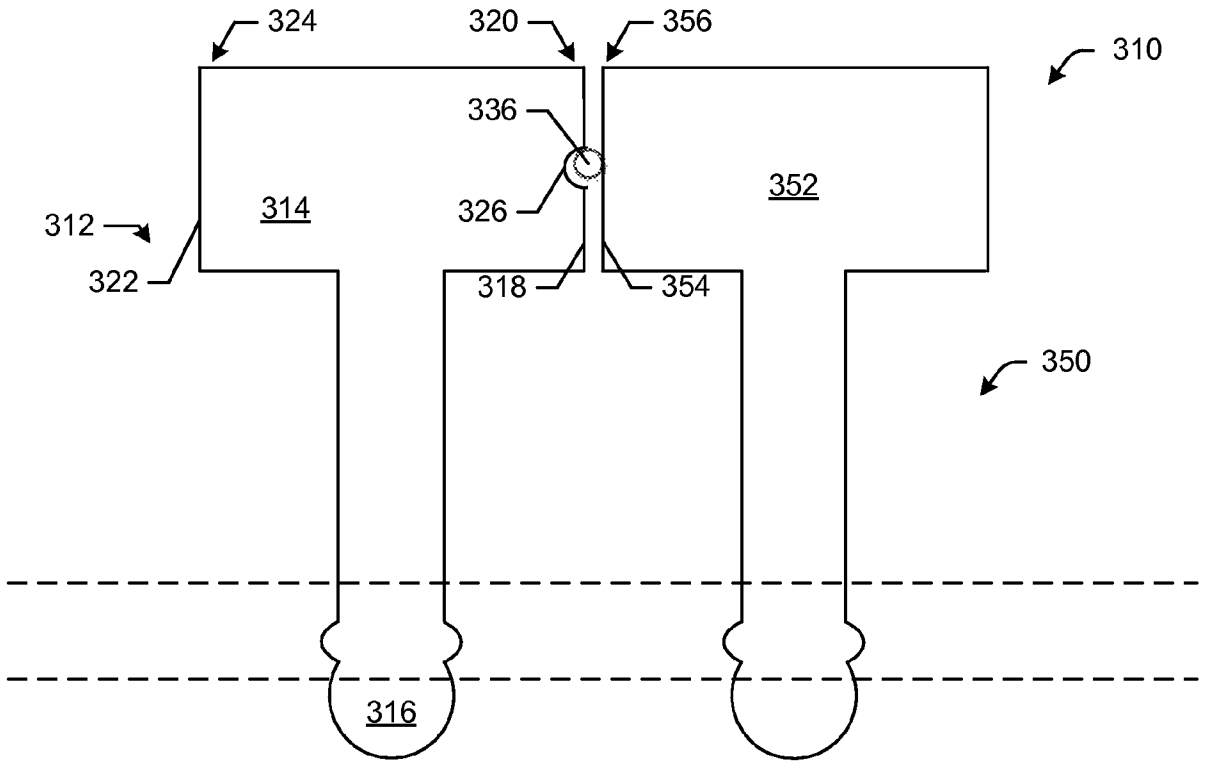
FIGS. 8-9 schematically depict a gas turbine shank assembly and a dome-ended seal pin in partial cross-sectional perspective view, according to one or more embodiments of the disclosure.
Figure 9:
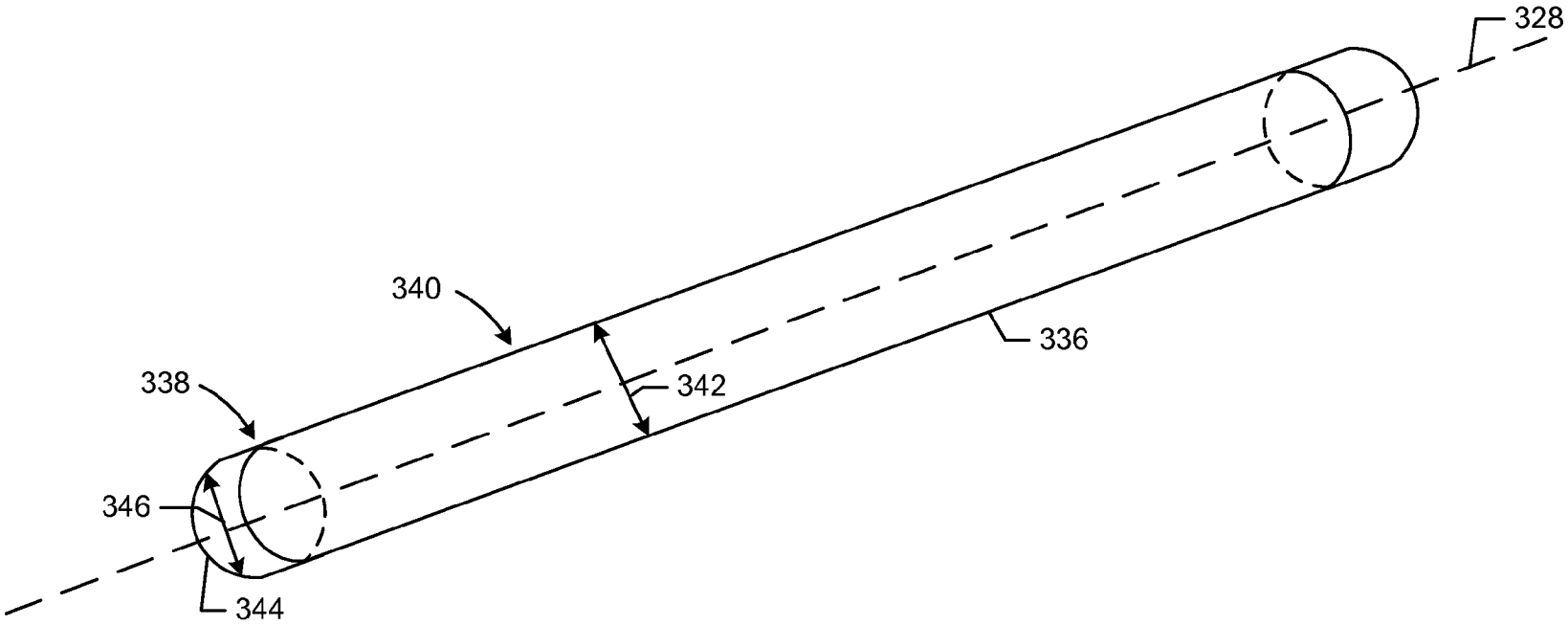

Referring now to FIGS. 8 and 9, another embodiment of a gas turbine sealing system 310 as described herein is illustrated. The gas turbine sealing system 310 includes a first near flow path seal or bucket shank 312 (illustrated without an airfoil) with a first platform 314 and a first dovetail 316 extending from the first platform 314. The first platform 314 includes a first slash face 318 on a first side 320 of the first platform 314 and a second slash face 322 on a second side 324 of the first platform 314 opposite the first side 320. The gas turbine sealing system 310 includes a seal pin slot 326 extending into the first slash face 318. The seal pin slot 326 may have a length defined along a major axis 328 of the first slash face 318, a width defined along a minor axis 330 of the first slash face 318, and a depth defined into the first slash face 318. For example, the depth may be measured as a distance into the first slash face 318 from an outer surface forming the first slash face 318. The seal pin slot 326 may have one or more chamfered ends. The gas turbine sealing system 300 may further include a seal pin 336 disposed in the seal pin slot 326. The seal pin 336 may have a dome portion 338 and a central portion 340 disposed adjacent to the dome portion 338, where the central portion 338 has a constant diameter 342. The dome portion 338 may have a first end adjacent to the central portion 338 and a second end forming an outer end 344 of the seal pin, where the first end has the constant diameter 342 of the central portion 340 and the outer end 344 has a diameter 346 less than the constant diameter 342, such that the outer end has a smaller radius than the radius of the central portion 340. The chamfered end of the seal pin slot may correspond to the one or more dome portions 338 of the seal pin 336, and the chamfered end may be configured such that the depth 332 of the seal pin slot 326 decreases across the first end of the seal pin slot 326. The gas turbine sealing system 300 may further include a second bucket shank 350 positioned adjacent to the first bucket shank 312 having a second platform 352 with a third slash face 354 positioned such that the seal pin 336 is retained in the seal pin slot 326. The third slash face 354 may be substantially planar, so as to hold the seal pin 336 in the seal pin slot 326 when the first and second bucket shanks 312, 350 are positioned adjacent to each other. A slash face gap 356 may be formed in between the first platform 314 and the second platform 352, and the seal pin 336 may occlude or otherwise block a portion or all of the slash face gap 356. The dome portion 338 may have a geometry configured to mate with the forward and aft ends of the seal pin slot 326, resulting in reduced leakage.

Embodiments of the disclosure may seal turbine wheel space cavities between adjacent bucket wheels of gas turbines from a hot gas path, resulting in reduced leakage flow, as well as the capability of using different materials for gas turbine engine components that may be less resistant and/or cheaper to manufacture. The seal pin may therefore effectively seal the turbine wheel space cavity by shielding the turbine wheels from the hot gas path. As a result, different materials (e.g., less heat resistant) may be used for components in the turbine wheel space.

The bucket shank and seal pin assembly described herein thus provides improved systems and methods for gas turbine component sealing. The seal pins described herein may reduce the leakage flow about the seal pin, and in particular the leakage flow about the forward end gap by reducing the effective clearance between the seal pin and the forward end of the seal pin slot. The seal pins described herein may also enhance the sealing of the slash gap, thereby resulting in a decreased amount of purge flow needed to maintain a desired differential pressure. The seal pins described herein may be implemented and/or utilized with little or no change in cost, as the seal pins may be installed during routine maintenance operations.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A shank assembly, comprising:

a shank with a platform comprising a first slash face;

a seal pin slot extending into the first slash face, wherein an end of the seal pin slot is chamfered; and a seal pin disposed in the seal pin slot, the seal pin comprising a dome-shaped end positioned adjacent to the end of the seal pin slot, wherein a ratio between a dome radius of the dome-shaped end of the seal pin to a pin radius of a central portion of the seal pin is greater than or equal to 1.1 and less than or equal to 1.8, wherein the central portion has a constant radius, wherein the dome-shaped end of the seal pin has a first portion and a second portion, wherein the first portion is adjacent to the central portion and comprises the constant radius, wherein the second portion is disposed opposite the first portion and comprises a radius less than the constant radius, wherein the end of the seal pin slot and the dome-shaped end of the seal pin collectively reduce a leakage area about the platform.

2. The shank assembly of claim 1, wherein the shank further comprises a second slash face that is substantially planar.

3. The shank assembly of claim 1, wherein the seal pin slot comprises a slot length and a depth.

4. The shank assembly of claim 3, wherein the seal pin has a seal pin length less than the slot length.

5. The shank assembly of claim 1, wherein the central portion is substantially cylindrical and is positioned adjacent to the dome-shaped end.

6. The shank assembly of claim 1, wherein a slot width of the seal pin slot is greater than the constant radius, such that the slot pin can move within the seal pin slot.

7. A method of reducing leakage flow in turbine wheel space cavities, the method comprising:

providing a first near flow path seal shank with a first platform comprising a first slash face;

providing a second near flow path seal shank with a second platform comprising a second slash face, wherein the second slash face is substantially planar and positioned adjacent to the first slash face;

positioning a seal pin in a seal pin slot disposed within the first slash face, wherein the seal pin comprises a dome-shaped end positioned adjacent to an end of the seal pin slot, wherein the end of the seal pin slot is chamfered, and wherein a ratio between a dome radius of the dome-shaped end of the seal pin to a pin radius of a central portion of the seal pin is greater than or equal to 1.1 and less than or equal to 1.8, wherein the central portion has a constant radius, wherein the dome-shaped end of the seal pin has a first portion and a second portion, wherein the first portion is adjacent to the central portion and comprises the constant radius, wherein the second portion is disposed opposite the first portion and comprises a radius less than the constant radius, wherein the end of the seal pin slot and the dome-shaped end of the seal pin collectively reduce a leakage area about the platform; and flowing cooling air in between the first slash face and the second slash face, wherein a hot gas path of the hot gas is occluded by the seal pin.

8. A gas turbine shank assembly, comprising:

a first shank comprising a first platform and a first dovetail extending from the first platform, the first platform comprising a first slash face on a first side of the first platform and a second slash face on a second side of the first platform opposite the first side;

a seal pin slot comprising a chamfered end and extending into the first slash face, the seal pin slot comprising a length defined along a major axis of the first slash face, a width defined along a minor axis of the first slash face, and a depth defined into the first slash face;

a seal pin disposed in the seal pin slot, the seal pin comprising a dome portion and a central portion disposed adjacent to the dome portion, wherein the central portion comprises a constant diameter, and the dome portion comprises a first end adjacent to the central portion and a second end forming an end of the seal pin, the first end having the constant diameter of the central portion, and the second end having a diameter less than the constant diameter, and wherein the chamfered end of the seal pin slot corresponds to the dome portion of the seal pin, such that the depth of the seal pin slot decreases across the first end of the seal pin slot, wherein a ratio between a dome radius of the dome portion to a pin radius of the central portion is greater than or equal to 1.1 and less than or equal to 1.8; and a second shank positioned adjacent to the first shank comprising a second platform with a third slash face positioned such that the seal pin is retained in the seal pin slot, wherein the chamfered end of the seal pin slot and the dome portion of the seal pin collectively reduce a leakage area about the first shank and the second shank.

9. The gas turbine shank assembly of claim 8, further comprising a slash face gap between the first platform and the second platform, wherein the seal pin occludes a portion of the slash face gap.

10. The gas turbine shank assembly of claim 8, wherein the third slash face is substantially planar.

* * * * *